US006994028B2

(12) United States Patent
Hiraoka

(10) Patent No.: US 6,994,028 B2
(45) Date of Patent: Feb. 7, 2006

(54) DEVELOPMENT PROCESS ON A PRESS OF PLANOGRAPHIC PRINTING PLATE MATERIAL AND PRINTING PROCESS

(75) Inventor: Saburou Hiraoka, Machida (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 53 days.

(21) Appl. No.: 10/809,632

(22) Filed: Mar. 24, 2004

(65) Prior Publication Data

US 2004/0206261 A1 Oct. 21, 2004

(30) Foreign Application Priority Data

Apr. 18, 2003 (JP) ..... 2003-114211

(51) Int. Cl.
*B41N 3/00* (2006.01)
*B41N 1/00* (2006.01)

(52) U.S. Cl. ..... 101/463.1; 101/467; 101/450.1; 430/302; 430/309

(58) Field of Classification Search ..... 101/463.1, 101/467, 453, 454, 457, 450.1; 430/302, 430/309

See application file for complete search history.

(56) References Cited

U.S. PATENT DOCUMENTS

| | | | |
|---|---|---|---|
| 6,030,750 A | 2/2000 | Vermeersch et al. | |
| 6,096,481 A | 8/2000 | Vermeersch et al. | |
| 2003/0172828 A1 | 9/2003 | Tabuchi et al. | |
| 2004/0187720 A1 * | 9/2004 | Naniwa et al. | 101/457 |

FOREIGN PATENT DOCUMENTS

| | | |
|---|---|---|
| EP | 0 770 494 A2 | 5/1997 |
| EP | 1 287 986 A1 | 3/2003 |
| JP | 09-123387 A | 5/1997 |

* cited by examiner

*Primary Examiner*—Leslie J. Evanisko
(74) *Attorney, Agent, or Firm*—Frishauf, Holtz, Goodman & Chick, P.C.

(57) ABSTRACT

Disclosed is a developing process on a press of a planographic printing plate material comprising a hydrophilic layer and an image formation layer, which is capable of being developed with water or capable of being developed on a press, the process comprising the steps of (a) supplying dampening water to the planographic printing plate material with a recorded image mounted on a plate cylinder of a press by bringing a dampening roller into contact with the planographic printing plate material while rotating the plate cylinder, and (b) then supplying ink to the planographic printing plate material by bringing an ink roller into contact with the planographic printing plate material to remove an image formation layer unnecessary for printing, wherein in the step (a), the supplied amount of the dampening water is varied.

13 Claims, 1 Drawing Sheet

DEVELOPMENT PROCESS ON A PRESS OF PLANOGRAPHIC PRINTING PLATE MATERIAL AND PRINTING PROCESS

FIELD OF THE INVENTION

The present invention relates to a developing process on a press of a planographic printing plate material and a printing process, and particularly to a developing process on a press in which development is smoothly carried out and a set-up time for printing is shortened.

BACKGROUND OF THE INVENTION

A printing plate is ordinarily prepared by imagewise exposing and developing a planographic printing plate material. As a developer used for developing the planographic printing plate material is used an aqueous alkali solution or an organic solvent. This has problem in safety and sanitation. Further, there is problem of environmental pollution in disposal of the developer waste.

In order to solve the above problems, a planographic printing plate material capable of being developed with water is disclosed in Japanese Patent O.P.I. Publication Nos. 58-2847, 58-49940, 58-2830, and 58-2834 which comprises a diazo resin and a water-softening polymer.

As a planographic printing plate material capable of developing with water on a press, there is a planographic printing plate material disclosed in U.S. Pat. Nos. 4,879,201, 4,916,041, 4,999,273, and 5,258,263, and JP-A-8-506191 and JP-A-8-507163, which comprises developing agent-contained microcapsules formed on a polymer resist or dispersed in a polymer resist; or a planographic printing plate material disclosed in JP-A-10-500915 which comprises a development stabilizing agent capable of forming a hydrogen bond. These can be used as a countermeasure to solve the above problems.

In Japanese Patent O.P.I. Publication Nos. 9-123387 and 9-123388 are disclosed a planographic printing plate material is disclosed which comprises an image formation layer containing hydrophobic thermoplastic polymer particles capable of being heat fused and a planographic printing plate material which comprises an image formation layer containing light-to-heat conversion materials, and a developing process on a press of these planographic printing plate materials. These propose a counter measure to solve the above problems and provide technique suitable for recent tendency to the digitization.

There are several Patent documents described regarding a developing process on a press of a planographic printing plate material capable of being developed on press. A process is disclosed in Japanese Patent O.P.I. Publication Nos. 9-123387 and 9-123388, which comprises the steps of providing, on a plate cylinder of a press, an image formation element with recorded image capable of being developed on a press; supplying dampening water to the element by contacting the element with a dampening roller; after ten rotations of the cylinder, supplying ink to the element by contacting the element with an inking roller; and after further ten rotations of the cylinder, providing a print with no stain at non-image portions.

However, this process is insufficient in development. For example, although no stain occurs at non-image portions at an initial printing stage, there is problem in that there occurs block (so-called filling-up) at high image density portions such as shadow portions, which is difficult to obtain prints with good image quality.

In Japanese Patent O.P.I. Publication No. 2000-52634, is disclosed a developing process on a press as described below.

The process is one in which a planographic printing plate material capable of being developed with water or of being developed on a press is developed on an off-set printing press according to the following procedure to prepare a planographic printing plate. The procedure comprises the steps of 1) imagewise heating or imagewise exposing a planographic printing plate material to form a recorded image on an image formation layer; 2) providing the printing plate material on a plate cylinder of a press; 3) supplying dampening water to the printing plate material by contacting a dampening roller with the printing plate material while rotating the plate cylinder, provided that an inking roller is not contacted with the printing plate material; and 4) transferring a part of the image formation layer to an image recording material (printing paper), whereby the planographic printing plate material is developed.

In this process, development of a planographic printing plate material is carried out by supply of dampening water and transfer of a part of the image formation layer to a printing paper, but it requires much time for development. This patent publication discloses that the supplied amount of dampening water supplied on development is 1.05 to 3.00 times the supplied amount of dampening water supplied during printing. However, it has been found that such an increase of the supplied amount of dampening water is insufficient to completely carry out development.

It has been found that it is necessary that after dampening water is supplied to a planographic printing plate material capable of being developed on a press, ink be supplied to the planographic printing plate material.

The present inventor has evaluated a planographic printing plate material capable of being developed on a press, varying the supplied amount of dampening water or inking roller nip timing, studied on conditions under which printing paper waste is reduced, and completed the invention.

SUMMARY OF THE INVENTION

An object of the invention is to provide a developing process on a press of a planographic printing plate material, whereby a planographic printing plate is prepared, and a printing process, the developing process and printing process providing prints with good image quality in a short time.

DETAILED DESCRIPTION OF THE INVENTION

Figure 1:
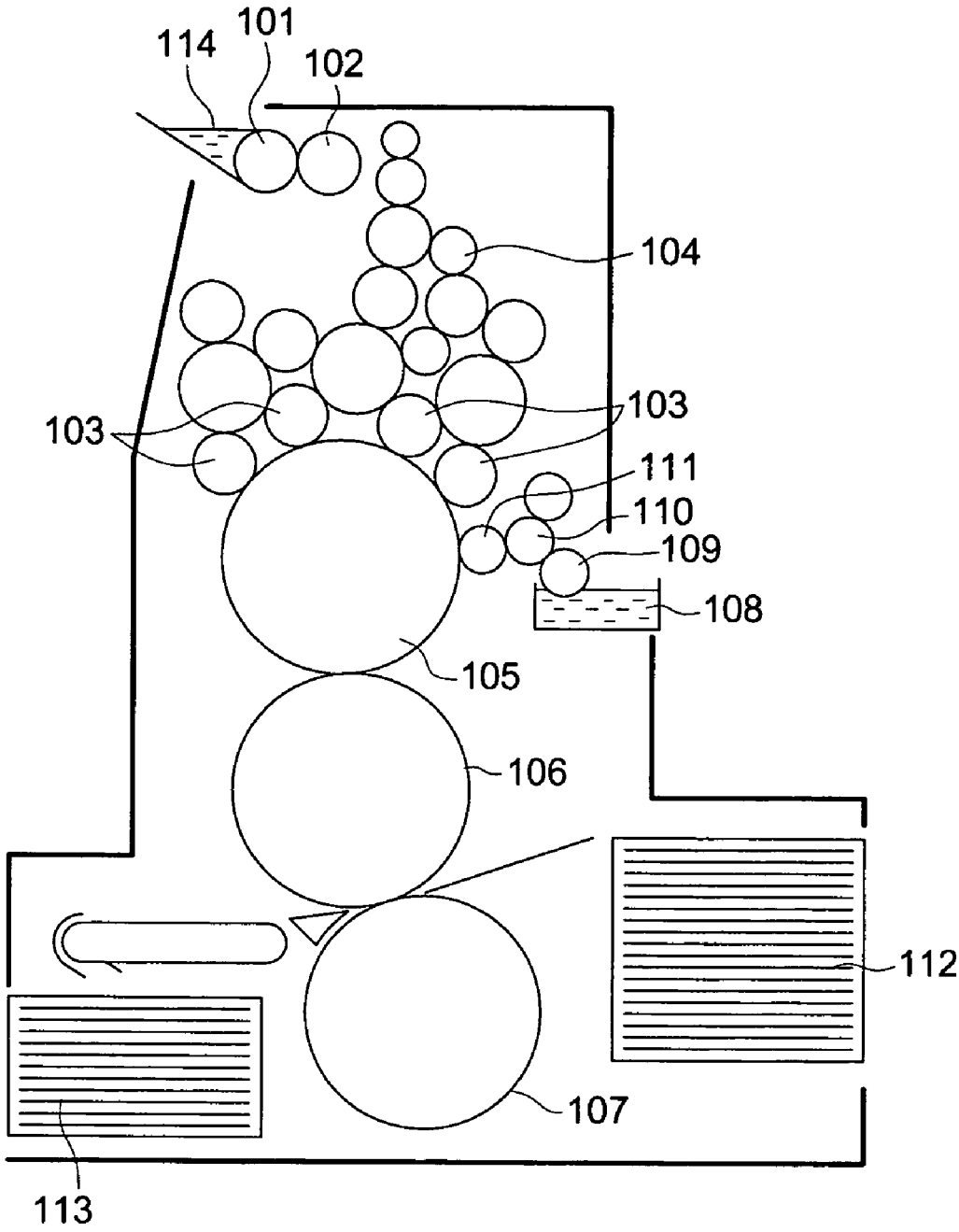
FIG. 1 shows a schematic view of a printing press.

The above object has been attained by one of the following constitutions:

1. A developing process on a press of a planographic printing plate material comprising a hydrophilic layer and an image formation layer, which is capable of being developed with water or capable of being developed on a press, the process comprising the steps of (a) supplying dampening water to the planographic printing plate material with a recorded image mounted on a plate cylinder of a press by bringing a dampening roller into contact with the planographic printing plate material while rotating the plate cylinder, and (b) then supplying ink to the planographic printing plate material by bringing an ink roller into contact with the planographic printing plate material to remove an image formation layer unnecessary for printing, wherein in the step (a), the supplied amount of the dampening water is varied.

2. The developing process of item 1 above, wherein the supplied amount of the dampening water at an initial stage of the step (a) is varied to be greater than that at a final stage of the step. (a).

3. The developing process of item 2 above, wherein the supplied amount of the dampening water at the initial stage of the step (a) is from 30 to 200 ml/m$^2$ of the planographic printing plate material, and the supplied amount of the dampening water at the final stage of the step (a) is from 5 ml/m$^2$ to less than 30 ml/m$^2$ of the planographic printing plate material.

4. A developing process on a press of a planographic printing plate material comprising a hydrophilic layer and an image formation layer, which is capable of being developed with water or capable of being developed on a press, the process comprising the steps of (a) supplying dampening water to a planographic printing plate material with a recorded image mounted on a plate cylinder of a press by bringing a dampening roller into contact with the planographic printing plate material while rotating the plate cylinder, and (b) then supplying ink to the planographic printing plate material by bringing an ink roller into contact with the planographic printing plate material to remove an image formation layer unnecessary for printing, wherein in the step (a), a circumferential speed of the plate cylinder (a distance which a point in the circumference of the plate cylinder advances in a unit time) is varied.

5. The developing process of item 4 above, wherein in the step (a), the circumferential speed of the plate cylinder is varied in the range of from 0.5 to 3.0 m/second.

6. The developing process of item 5 above, wherein at a certain period in the step (a), the circumferential speed of the plate cylinder is 2.0 to 3.0 m/second.

7. A developing process on a press of a planographic printing plate material comprising a hydrophilic layer and an image formation layer, which is capable of being developed with water or capable of being developed on a press, the process comprising the steps of (a) supplying dampening water to a planographic printing plate material with a recorded image mounted on a plate cylinder of a press by bringing a dampening roller into contact with the planographic printing plate material while rotating the plate cylinder, and (b) then supplying ink to the planographic printing plate material by bringing an ink roller into contact with the planographic printing plate material to remove an image formation layer unnecessary for printing, wherein in the step (b), a circumferential speed of the plate cylinder is varied.

8. The developing process of item 7 above, wherein in the step (b), the circumferential speed of the plate cylinder is varied in the range of from 0.5 to 3.0 m/second.

9. A developing process on a press of a planographic printing plate material comprising a hydrophilic layer and an image formation layer, which is capable of being developed with water or capable of being developed on a press, the process comprising the steps of (a) supplying dampening water to a planographic printing plate material with a recorded image mounted on a plate cylinder of a press by bringing a dampening roller into contact with the planographic printing plate material while rotating the plate cylinder, and (b) then supplying ink to the planographic printing plate material by bringing an ink roller into contact with the planographic printing plate material to remove an image formation layer unnecessary for printing, wherein a circumferential speed of the plate cylinder in the step (a) is different from that in the step (b).

10. A printing process comprising the steps of developing a planographic printing plate material comprising a hydrophilic layer and an image formation layer, which is capable of being developed with water or capable of being developed on a press, according to the developing process of item 1 above to prepare a planographic printing plate, supplying ink and dampening water to the resulting planographic printing plate to form an ink image on the planographic printing plate, and transferring the ink image to a paper sheet.

11. A printing process comprising the steps of developing a planographic printing plate material comprising a hydrophilic layer and an image formation layer, which is capable of being developed with water or capable of being developed on a press, according to the developing process of item 4 above to prepare a planographic printing plate, supplying ink and dampening water to the resulting planographic printing plate to form an ink image on the planographic printing plate, and transferring the ink image to a paper sheet.

12. A printing process comprising the steps of developing a planographic printing plate material comprising a hydrophilic layer and an image formation layer, which is capable of being developed with water or capable of being developed on a press, according to the developing process of item 7 above to prepare a planographic printing plate, supplying ink and dampening water to the resulting planographic printing plate to form an ink image on the planographic printing plate, and transferring the ink image to a paper sheet.

13. A printing process comprising the steps of developing a planographic printing plate material comprising a hydrophilic layer and an image formation layer, which is capable of being developed with water or capable of being developed on a press, according to the developing process of item 9 above to prepare a planographic printing plate, supplying ink and dampening water to the resulting planographic printing plate to form an ink image on the planographic printing plate, and transferring the ink image to a paper sheet.

1-1. A developing process on a press of a planographic printing plate material capable of being developed with water or capable of being developed on a press, the process comprising the steps of (a) supplying dampening water to a planographic printing plate material with a recorded image on a plate cylinder of a press by bringing a dampening roller into contact with the printing plate material while rotating the plate cylinder, and (b) then supplying ink to the planographic printing plate material by bringing an inking roller into contact with the planographic printing plate material, wherein in the step (a), the supplied amount of the dampening water is varied.

1-2. The developing process of item 1-1 above, wherein the supplied amount of the dampening water at an initial stage of the step (a) is greater than that at a final stage of the step (a).

1-3. The developing process of item 1-2 above, wherein the supplied amount of the dampening water at an initial stage of the step (a) is from 30 to 200 ml/m$^2$ of the planographic printing plate material, and the supplied amount of the dampening water at a final stage of the step (a) is from 5 ml/m$^2$ to less than 200 ml/m$^2$ of the planographic printing plate material.

1-4. A developing process of developing on a press a planographic printing plate material capable of being developed with water or capable of being developed on a press, the process comprising the steps of (a) supplying dampening water to a planographic printing plate material with a recorded image on a plate cylinder of a press by bringing a dampening roller into contact with the printing plate material while rotating the plate cylinder, and (b) then supplying ink to the planographic printing plate material by bringing an inking roller into contact with the planographic printing plate material, wherein in the step (a), the circumferential speed of the plate cylinder is varied.

1-5. The developing process of item 1-4 above, wherein in the step (a), the circumferential speed of the plate cylinder (a distance which a point in the circumference of the plate cylinder advances in a unit time) is varied in the range of from 0.5 to 3.0 m/second.

1-6. The developing process of item 1-5 above, wherein in the step (a), the circumferential speed of the plate cylinder is 2.0 to 3.0 m/second.

1-7. A printing process comprising the steps of developing a planographic printing plate material according to the developing process of any one of items 1-1 through 1-6 above to prepare a planographic printing plate, supplying ink and dampening water to the resulting planographic printing plate to form an ink image on the planographic printing plate, and transferring the ink image to a paper sheet.

The present invention will be explained in detail below.

(Developing Process on a Press)

Commonly known printing presses can be used as a printing press in the invention, as long as it can adjust the supplied amount of dampening water and vary the rotation frequency of the plate cylinder in the developing process (or pre-dampening step). Particularly, a printing press comprising a control board capable of varying the supplied amount of dampening water and the rotation frequency of the plate cylinder is preferred in view of ease in operation. Herein, a method of operating a printing press will be explained, employing a schematic view of the printing press as shown in FIG. 1.

FIG. 1 shows a schematic view of a printing press for single color printing. Inking roller 103 and dampening roller 111 are provided near cylinder (plate cylinder) 105 for mounting a printing plate.

The inking roller 103 is a roller for supplying, to a planographic printing plate mounted on the cylinder 105, ink transported from ink fountain 114 through ink fountain roller 101 and ink ductor roller 102 to plural ink distributing rollers 104 where the ink is more fluidized by shearing of the ink distributing rollers 104, the inking roller being brought into contact with the cylinder 105 during the pre-dampening step or printing step through a control panel connected to a CPU. The rotation speed of the inking roller is synchronized with that of the cylinder.

The dampening roller 111 is a roller for supplying, to a planographic printing plate mounted on the cylinder 105, dampening water transported from dampening water tank 108 through dampening water fountain roller 109 and dampening water ductor roller 110, the dampening roller 111 being brought into contact with the cylinder 105 during the pre-dampening step or printing step through a control panel connected to a CPU. The rotation speed of the dampening roller is synchronized with that of the cylinder. In order to increase the supplied amount of dampening water, a rotation frequency of ink fountain roller 109 is increased, whereby the amount of dampening water transported to dampening water ductor roller 110 is also increased.

During printing, dampening water and ink are supplied to a planographic printing plate to form an ink image on the planographic printing plate, the ink image is transferred to blanket cylinder 106, and further transferred to printing paper 112 transported between blanket cylinder 106 and impression cylinder 107, whereby printing is carried out to obtain prints 113.

In the invention, a printing plate material is imagewise exposed to light such as laser to form a recorded image on the planographic printing plate material, which is mounted on a plate cylinder. When a printing press installed with an exposure device is used, a planographic printing plate material is mounted on the plate cylinder and imagewise exposed employing the exposure device, and then dampening water is supplied by dampening roller 111 to the exposed planographic printing plate material.

The present invention is a developing process on a press of a planographic printing plate material comprising a hydrophilic layer and an image formation layer, which is capable of being developed with water or capable of being developed on a press, and is characterized in that the process comprises the steps of (a) supplying dampening water to the planographic printing plate material with a recorded image mounted on a plate cylinder of a press by bringing the planographic printing plate material into contact with a dampening roller while rotating the plate cylinder, and (b) then supplying ink to the planographic printing plate material by bringing an ink roller into contact with the planographic printing plate material to remove an image formation layer unnecessary for printing, wherein in the step (a), the supplied amount of the dampening water is varied.

In the invention, it is preferred that in the pre-dampening step (development step) carried out before a printing is carried out while printing sheet is fed, dampening water is initially supplied in an amount greater than the ordinary supplied amount of dampening water supplied during printing and thereafter, dampening water is supplied immediately before the beginning of printing in the same amount as the ordinary amount supplied during printing.

In the invention, in the pre-dampening step, after dampening water is supplied to a planographic printing plate material, ink is supplied to the planographic printing plate material by bringing an inking roller into contact with the planographic printing plate material, whereby complete development is carried out.

That is, in the invention, in the pre-dampening step dampening water is initially supplied to a planographic printing plate material in an amount greater than the ordinary supplied amount of dampening water supplied during printing, is supplied immediately before the beginning of printing to the planographic printing plate material in the same amount as the ordinary amount supplied during printing, and then ink is supplied to the planographic printing plate material by bringing an inking roller into contact with the planographic printing plate material, whereby complete development on a press is carried out, and paper waste is reduced.

The developing process of the invention comprises the step of supplying dampening water to the planographic printing plate material, followed by supply of ink. The process removes, together with the supplied ink, for example, a hydrophobic heat melt material-containing layer (described later), which is a layer other than a hydrophobic layer formed by exposing to laser and heat-melting the heat melt material in the hydrophobic heat melt material-containing layer, or an image formation layer which has been ablated by exposing to laser (described later), whereby development is completed.

It is preferred that dampening water is initially supplied to the planographic printing plate material in an amount greater than the supplied amount of dampening water ordinarily supplied during printing. The supplied amount of the dampening water is an amount such that the dampening water spreads over the entire surface of the planographic printing plate, a layer unnecessary for printing is lifted from the planographic printing plate material surface, and excessive dampening water does not remain on the planographic printing plate material surface before printing.

When the supplied amount of dampening water is increased in a printing press as shown in FIG. 1, the rotation frequency of the dampening water fountain roller is initially greater, and dampening water is supplied to a planographic printing plate material in an amount of preferably from 30 to 200 ml/m$^2$ of planographic printing plate material, whereby dampening water spreads over the entire surface of the planographic printing plate material and a layer (an image formation layer) unnecessary for printing is lifted from the planographic printing plate material surface. In this case, it is preferred that the rotation frequency of the plate cylinder is maintained at one to ten, and it is more preferred that the rotation frequency of the plate cylinder is maintained at one to five, in view of shortening of the set-up time for printing. Subsequently, the dampening water supplied amount is preferably reduced to an amount of from 5 ml/m$^2$ to less than 30 ml/m$^2$ of planographic printing plate material, whereby no excessive dampening water remains on the printing plate at the beginning of printing and prints with the intended ink density can be obtained from the initial stage of printing.

After the dampening water spreads over the entire surface of the planographic printing plate material and the layer unnecessary for printing is lifted from the planographic printing plate material surface, ink is supplied to the planographic printing plate material by bringing an inking roller into contact with the planographic printing plate material, where a layer unnecessary for printing, which is lifted from the surface of the material or becomes easy to be removed, is removed employing the tackiness of the supplied ink. In this case, this step is preferably carried out in a short time in order to prevent the layer to have been removed from entering the ink. This step is preferably completed in a short time, and in this step the rotation frequency of the plate cylinder is preferably two to nine. After the layer unnecessary for printing is removed by the tackiness of the supplied ink, printing paper is fed and printing is carried out.

Another embodiment of the invention of the above developing process on a press of a planographic printing plate material capable of being developed on a press comprises the step of supplying dampening water to a planographic printing plate material with a recorded image on a plate cylinder of a press by bringing a dampening roller into contact with the printing plate material while rotating the plate cylinder, wherein the circumferential speed (a distance which a point in the circumference of the plate cylinder advances in a unit time) of the plate cylinder is varied. This step is preferred in that development is completely carried out and paper waste is reduced at the beginning of printing.

In the developing process on a press of the invention, it is preferred that the rotation frequency of the plate cylinder (hereinafter also referred to as simply a cylinder) is increased while supplying dampening water. It is preferred that dampening water is spread over the entire surface of the planographic printing plate material by an increase of the circumferential speed of the cylinder for increasing the rotation frequency of the cylinder, whereby a layer unnecessary for printing is lifted from the planographic printing plate material surface, and then is removed. The rotation frequency of the plate cylinder in this pre-dampening step is preferably maintained at one to ten.

The circumferential speed of the cylinder (a distance over which a point in the circumference of the plate cylinder advances in a unit time) is varied in the range of preferably from 0.5 to 3.0 m/second. Typically, where dampening water id supplied in the pre-dampening step, the circumferential speed of the cylinder is from 2.0 to 3.0 m/second, which is greater than 0.5 to 3.0 m/second, being the ordinary circumferential speed of the cylinder, whereby a layer unnecessary for printing is likely to be removed. This condition in this pre-dampening step is preferably maintained during one to ten rotations of the cylinder, and is more preferably maintained during one to five rotations in view of shortening the set-up time for printing. Thereafter, the circumferential speed of the cylinder is reduced to between 0.5 m/second and less than 2.0 m/second.

Accordingly, the preferred embodiment of the developing process of the invention is a process in which in the step (a) above, that is, in the step of supplying dampening water to a planographic printing plate material with a recorded image on a plate cylinder of a press by bringing a dampening roller into contact with the printing plate material while rotating the plate cylinder, a circumferential speed of the cylinder is initially 2.0 to 3.0 m/second, and then is reduced to between 0.5 m/second and less than 2.0 m/second, whereby in the pre-dampening step a layer unnecessary for printing is completely removed.

In order to make it easy to remove the layer unnecessary for printing, it is preferred that not less than three rotations of the cylinder are carried out while the circumferential speed of the cylinder is maintained between 2.0 and 3.0 m/second.

Thus, dampening water is supplied to a planographic printing plate material, and then ink is supplied to the planographic printing plate material by bringing an inking roller into contact with the planographic printing plate material, and the layer unnecessary for printing, which is lifted from the surface of the material or is easily removed, is removed employing the tackiness of the supplied ink. In this case, this step is preferably carried out in a short time in order to prevent the removed layer from mixing with the ink. This step is completed in preferably two to nine rotations of the cylinder. After the layer unnecessary for printing is removed by the tackiness of the supplied ink, printing paper is fed and printing is carried out.

Preferred sequences of the developing process on a press of the invention will be explained below. In the following tables are shown the rotation frequency of the cylinder and the circumferential speed (m/sec) of the cylinder in the pre-damping step (as cylinder conditions), the supplied amount (ml/m$^2$ of planographic printing plate material) of dampening water at each of specific cylinder rotations, whether or not the inking roller is in contact with the planographic printing plate material, and whether or not paper for printing has been fed. Further, whether each stage is in the pre-dampening step or in the printing step is also shown.

(a) In the developing process in which the supplied amount of dampening water is varied.

TABLE 1

| | | | | | |
|---|---|---|---|---|---|
| 1) | 6) | 1st to 5th | 6th to 7th | 8th to 10th | Not less than 11th |
| | 7) | 0.5 m/sec | 0.5 m/sec | 0.5 m/sec | 1.0 m/sec |
| 2) | 8) | 75 ml/m$^2$ | 10 ml/m$^2$ | 10 ml/m$^2$ | 10 ml/m$^2$ |
| 3) | 9) | No | No | Yes | Yes |
| 4) | 10) | No | No | No | Yes |
| 5) | | Pre-dampening step (developing process on a press) | | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding (b) In the developing process in which a circumferential speed of plate cylinder is varied.

TABLE 2

| | | | | |
|---|---|---|---|---|
| 1) | 6) | 1st to 7th | 8th to 10th | Not less than 11th |
| | 7) | 0.5 m/sec | 0.5 m/sec | 1.0 m/sec |
| 2) | 8) | 10 ml/m$^2$ | 10 ml/m$^2$ | 10 ml/m$^2$ |
| 3) | 9) | No | Yes | Yes |
| 4) | 10) | No | No | Yes |
| 5) | | Pre-dampening step (developing process on a press) | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding The developing process on a press, in which the pre-dampening step described above is carried out, can shorten developing time of the planographic printing plate material capable of being developed on a press, i.e., the set-up time for printing, and can reduce printing paper waste at an initial printing step.

Next, the planographic printing plate material capable of being developed on a press used in the invention will be explained.

<Planographic Printing Plate Material>

In the invention, the planographic printing plate material capable of being developed with water or capable of being developed on a press comprises a hydrophilic layer and an image formation layer. Preferred examples of the planographic printing plate material in the invention include the following planographic printing plate material 1) or 2).

1) A planographic printing plate material comprising a hydrophilic layer and provided thereon, a thermosensitive layer (as the image formation layer) containing thermoplastic or heat melt particles, hydrophobic precursors or microcapsules. This planographic printing plate material is imagewise heated, and subjected to development in which the image formation layer unnecessary for printing is removed by dampening water and printing ink. Such a material is disclosed in Japanese Patent O.P.I. Publication Nos. 9-123387, 2001-96710, 2001-334766, 2002-361996, and 2002-178665.

2) A planographic printing plate material comprising two layers, a hydrophilic layer and an ink affinity layer as an image formation layer, each having a different ink affinity. This planographic printing plate material is imagewise heated where a part of one layer of the two layers is destructed by ablation, and subjected to development in which the part destructed is removed. Such a material is disclosed in Japanese Patent O.P.I. Publication Nos. 9-297395, 10-26826 and 2002-293050.

As the hydrophilic layer of the planographic printing plate material of 1) above, there is a layer containing a hydrophilic resin or self film-forming particles, and inorganic particles. Examples of the hydrophilic resin used include polyvinyl alcohol, acryl polymers, polyurethanes, and cellulose derivatives. The polyvinyl alcohol has a saponification degree of not less than 95%. The polyvinyl alcohol may be modified with a carboxyl group.

Examples of the acryl polymers used include a polymer having a high content of a monomer unit having a high hydrophilic property. Examples of the monomer having a high hydrophilic property include acrylamide, methylolacrylamide, methylolmethacrylamide, acrylic acid, methacrylic acid, hydroxyethyl acrylate, hydroxyethyl methacrylate, a monomer having an ammonium or phosphonium group, and a monomer having a sulfonic acid group, a phosphonic acid group or a phosphate group. Polymer salts can be used which is obtained by neutralizing the above polymers having an acidic group with an alkali.

Examples of the polyurethanes used include those having in the side chain a hydrophilic group such as a carboxyl group, a phosphate group, a sulfonic acid group, an amino group or their salt group, a hydroxyl group, an amido group or a polyoxyethylene group.

Examples of the cellulose derivatives used include hydroxyethylcellulose, carboxymethylcellulose, hydroxypropylmethylcellulose, and hydroxypropylcellulose.

Examples of the film-forming particles include alumina sol or colloidal silica particles. Colloidal silica particles with a particle size of not more than 50 nm are preferred in that strength or hydrophilicity of the hydrophilic layer is increased. Typically, "Snowtex" series, produced by Nissan Kagaku Kogyo Co., Ltd., can be used. In order to provide a proper layer strength or water retention property of the hydrophilic layer, necklace-shaped colloidal silica particles can be used. The necklace-shaped colloidal silica particles used in the invention refer to a general term of an aqueous dispersion containing spherical silica particles with a primary order particle diameter in "nm" order. Examples of the necklace-shaped colloidal silica particles include Snowtex PS series produced by Nissan Kagaku Kogyo Co., Ltd. The alkaline products of the series include Snowtex PS-S (an average particle diameter of 110 nm in a combined form), Snowtex PS-M (an average particle diameter of 120 nm in a combined form), and Snowtex PS-L (an average particle diameter of 170 nm in a combined form). The corresponding acidic products are Snowtex PS-S-O, Snowtex PS-M-O, and Snowtex PS-L-O, respectively. The self film-forming particles herein refers to those in which when the particles are coated on a base to form a film of a dry thickness of 1.0 $\mu$m, and dried at 100° C. for 3 minutes, the film, after rubbed with a sponge, causes no defects on the surface.

The hydrophilic resin and the self film-forming particles may be used in combination.

The inorganic particles usable for the hydrophilic layer include calcium carbonate, barium sulfate, silica, titanium oxide, clay, and alumina. Silica, alumina, titanium oxide and zinc oxide are preferred in that in the hydrophilic layer, mechanical strength, hydrophilicity and water retention are increased, and desensitizing treatment is effectively carried out. The average particle size of the inorganic particles is preferably from 0.01 to 10 μm, and more preferably from 0.05 to 5 μm. Herein, the average particle size of the inorganic particles is the average of the particle size of 100 particles measured by SEM/TEM.

The content ratio by weight of the hydrophilic layer resin or the self film-forming particles to the inorganic particles is preferably (2–50):(10–50), in unevenness of the hydrophilic layer surface providing a hydrophilic layer having excellent mechanical strength, water retention and image durability (hereinafter also referred to as image printing durability).

The hydrophilic layer in the invention may have a cross-linked structure in order to further increase its mechanical strength. As a cross-linking agent, formaldehyde, an epoxy resin, a melamine resin, glyoxal, polyisocyanate, and hydrolyzable tetraalkylorthosilicate can be used. The content of the cross-linking agent in the hydrophilic layer is from more than 0 to 1% by weight.

The hydrophilic layer is ordinarily coated directly or through the image formation layer on a substrate. The substrate is not limited, but preferably a metal foil, a paper sheet, a plastic sheet or a composite thereof.

The thickness of the substrate is preferably from 100 to 290 μm, and more preferably from 150 to 250 μm.

Examples of the plastic sheet include sheets of polyethylene terephthalate, polyethylene naphthalate, polyimide, polyamide, polycarbonate, polysulfone, polyphenylene oxide, and cellulose ester. The plastic sheet is preferably a polyethylene terephthalate sheet or a polyethylene naphthalate sheet.

The coating amount of the hydrophilic layer on the substrate is preferably from 0.5 to 10 g/m$^2$, and more preferably from 1.0 to 5 g/m$^2$.

Another embodiment of the hydrophilic layer is an aluminum plate subjected to electro-chemical and/or mechanical graining, and then anodization treatment, and typically an aluminum plate whose surface is subjected to roughening treatment, anodization treatment and sealing treatment.

As a method for surface roughening an aluminum plate are known a mechanical surface-roughening method and an electrolytically etching method. Examples of the mechanical surface-roughening method include a ball graining method, a brush graining method, a liquid horning method and a buffing method. The methods described above can be used singly or in combination according to composition of aluminum material. The electrolytically etching method is preferred.

The electrolytically etching method is carried out in a solution containing one or more kinds of phosphoric acid, sulfuric acid, hydrochloric acid, and nitric acid. The surface roughened aluminum plate is optionally subjected to desmut treatment in an alkaline or acidic solution, neutralized, and washed with water.

The anodization treatment is carried out in an electrolyte solution such as a solution containing one or more kinds of sulfuric acid, chromic acid, oxalic acid, phosphoric acid, and malonic acid, employing the aluminum plate to be treated as an anode to form an anodization film. The thickness of the anodization film is suitably from 1 to 50 mg/dm$^2$, and preferably from 10 to 40 mg/dm$^2$.

Examples of the sealing treatment include boiling water treatment, water vapor treatment, sodium silicate treatment, and aqueous dichromate solution treatment.

As another method, a subbing layer can be provided on an aluminum plate employing an aqueous solution containing a water soluble polymer or a metal salt such as fluorozirconate.

<Thermosensitive Layer>

(Thermoplastic or Heat-Fusible Particles)

Examples of particles of the thermoplastic or heat-fusible materials which are contained in a thermosensitive layer provided on a hydrophilic layer, include particles of known thermoplastic resins, synthetic rubbers or waxes.

Examples of the thermoplastic resins include acryl resins, styrene-acryl resins, polyesters, polyurethanes, polyethers, polyethylene, polypropylene, polystyrene, ionomer resins, vinyl acetate resins, and vinyl chloride resins.

Examples of the synthetic rubbers include polybutadiene, polyisoprene, polychloroprene, styrene-butadiene copolymer, an acrylate-butadiene copolymer, a methacrylate-butadiene copolymer, isobutylene-isoprene copolymer, acrylonitrile-butadiene copolymer, acrylonitrile-isoprene copolymer, and styrene-isoprene copolymer.

Of the thermoplastic resins or synthetic rubbers described above, those having a melting point or softening point of not less than 60° C. and having a contact angle to water of not less than 50 degrees are advantageous in view of S/N ratio in image or sensitivity. Herein, the contact angle is that of a sheet of the thermoplastic resins or synthetic rubbers to water.

Examples of the waxes used include natural waxes such as carnauba wax, bees wax, spermaceti wax, Japan wax, jojoba oil, lanolin, ozocerite, paraffin wax, montan wax, candelilla wax, ceresine wax, microcrystalline wax and rice wax; polyethylene wax; Fischer-Tropsh wax; montan wax derivatives; paraffin wax derivatives; microcrystalline wax derivatives; and higher fatty acids. Of these, those having a melting point of from 50 to 150° C., and a melt viscosity at 140° C. of not more than 0.02 Pa/s are preferred in view of S/N ratio in image or sensitivity. Further, those having a penetration defined in JIS K2530-1966 of not more than 1 are preferred in view of printing durability.

Carnauba wax, candelilla wax, and FT wax are preferable as heat-fusible materials satisfying the physical properties described above.

Further, the average particle diameter of particles of the thermoplastic or heat-fusible materials contained in the thermosensitive layer is preferably 0.1 to 0.5 μm. The physical properties described above are important to provide high printing durability. The content of the particles of the thermoplastic or heat-fusible materials in the thermosensitive layer is preferably from 40 to 100% by weight.

(Hydrophobic Precursors)

The hydrophobic precursors used in the invention may be any as long as an affinity to printing ink is produced by heat application, and there is, for example, a polymer having an aryldiazosulfonate group, and typically, a polymer containing in the molecule a monomer unit having an aryldiazosulfonate group represented by the following formula.

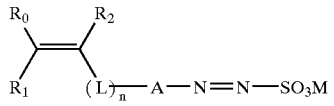

In formula above, $R_0$, $R_1$ and $R_2$ independently represent a hydrogen atom, an alkyl group, a nitrile group or a halogen atom; L represents a divalent linkage group; n represents 0 or 1; A represents an arylene group; and M represents a cationic group.

Examples of the divalent linkage group represented by L include a divalent linkage group selected from the group consisting of —(X)t—$CONR_3$—, —(X)t—COO—, —X—, and —(X)t—CO—, in which t represents 0 or 1, $R_3$ represents a hydrogen atom, an alkyl group or an aryl group, and X represents an alkylene group, an arylene group, an alkyleneoxy group, an aryleneoxy group, an alkylenethio group, an arylenethio group, an alkyleneamino group, an aryleneamino group, oxygen, sulfur, or an imino group.

A is preferably an unsubstituted arylene group (for example, an unsubstituted phenylene group), or an arylene group (for example, a phenylene group) having a substituent such as an alkyl group, an aryl group, an alkoxy group, an aryloxy group, or an amino group.

Examples of M include a cation, for example, $NH_4^+$, and a metal ion, for example, a cation of a metal such as Al, Cu, Zn, an alkaline earth metal or an alkali metal.

The polymer having an aryldiazosulfonate group is preferably prepared by polymerization of the corresponding monomer having an aryldiazosulfonate group. The monomer having an aryldiazosulfonate group is disclosed in EP-A-339393 and EP-A-507008. Preferred examples of the monomer will be listed below.

M1

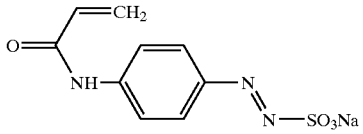

M2

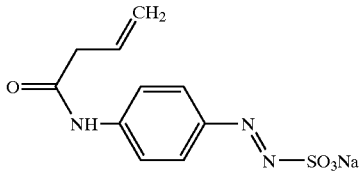

M3

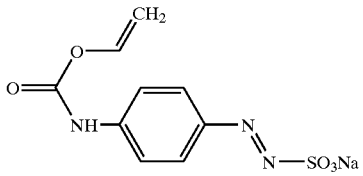

M4

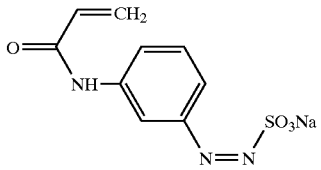

-continued

M5

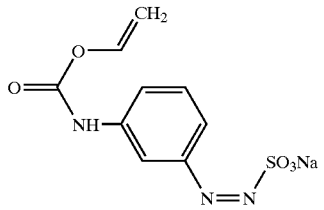

M6

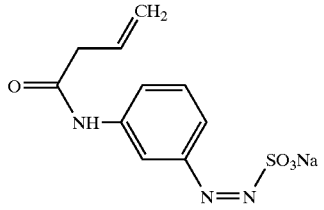

M7

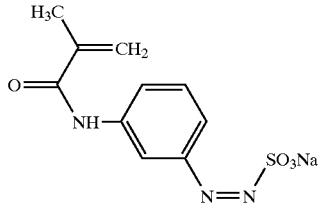

M8

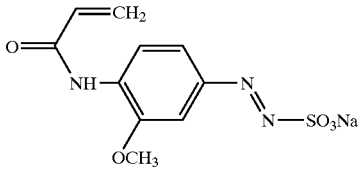

M9

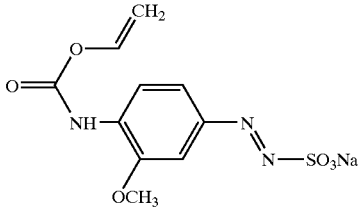

M10

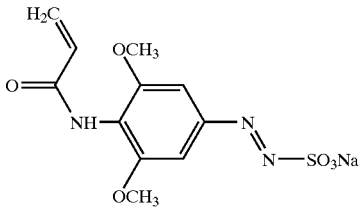

M11

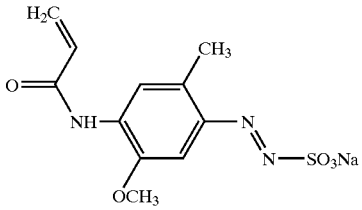

-continued

M12

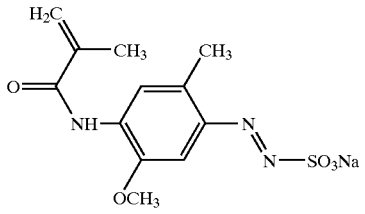

M13

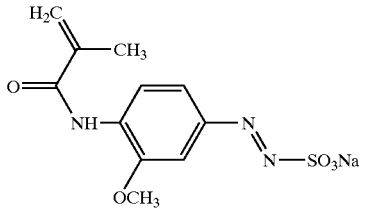

M14

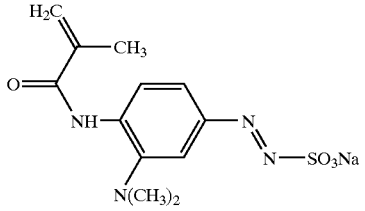

M15

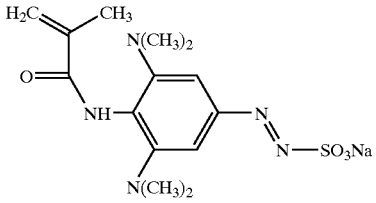

M16

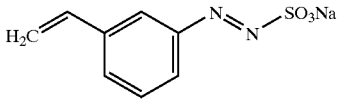

M17

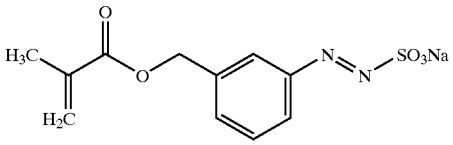

M18

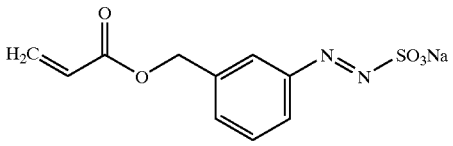

M19

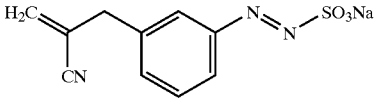

The polymer having an aryldiazosulfonate group may be a polymer obtained by homopolymerization of a monomer having an aryldiazosulfonate group or a copolymer obtained by copolymerization of a monomer having an aryldiazosulfonate group with a monomer having another aryldiazosulfonate group or another monomer such as (meth)acrylic acid or its esters, (meth)acrylamide, acrylonitrile, vinyl acetate, vinyl chloride, vinylidene chloride, styrene, or α-methylstyrene. The copolymer should be prepared so that it does not lose a water soluble property. The content of the monomer unit having an aryldiazosulfonate group in the polymer having an aryldiazosulfonate group is preferably from 10 to 60 mol %.

(Microcapsules)

As the microcapsules in the invention, there are microcapsules encapsulating a compound having a heat-reactive functional group. Examples of the heat-reactive functional group include a polymerizable unsaturated group, an isocyanate group, an epoxy group, a hydroxy group, a carboxyl group, a methylol group, an amino group, and a diazosulfonate group. An isocyanate group or a diazosulfonate group is preferred in view of sensitivity for practical use.

Examples of the compound having an isocyanate group include 2,4-tolylenediisocyanate, 2,6-tolylenediisocyanate, 4,4'-diphenylmethane diisocyanate, 1,5-naphthalene diisocyanate, tolidinediisocyanate, 1,6-hexamethylenediisocyanate, isophoronediisocyanate, xylylenediisocyanate, lysinediisocyanate, triphenylmethanetriisocyanate, and bicycloheptanediisocyanate.

As the compound having a diazosulfonate group, the hydrophobic precursors described above can be used.

As a method of preparing microcapsules encapsulating the compound having a heat reactive functional group or the hydrophobic precursors described above, known methods can be used, which include a coacervation method disclosed in U.S. Pat. Nos. 2,800,457 and 2,800,458; an interfacial polymerization method disclosed in British Patent No. 990,443, U.S. Pat. No. 3,287,154, and Japanese Patent Publication Nos. 38-19574, 42-446, and 42-711; a polymer precipitation method disclosed in U.S. Pat. Nos. 3,418,250 and 23,660,304; a method employing isocyanatepolyol as a wall material disclosed in U.S. Pat. No. 3,796,669; a method employing isocyanate as a wall material disclosed in U.S. Pat. No. 3,914,511; a method employing urea-formaldehyde resin or urea-formaldehyde-resorcinol resin as a wall material disclosed in U.S. Pat. Nos. 4,001,140, 4,087,376 and 4,089,802; a method employing melamine-formaldehyde resin or hydroxycellulose as a wall material disclosed in U.S. Pat. No. 40,254,450; an in-situ method employing polymerization of a monomer disclosed in Japanese Patent Publication Nos. 36-9163 and 51-9079; a spray drying method disclosed in British Patent No. 930,422 and U.S. Pat. No. 3,111,407; and an electrolytic dispersing and cooling method disclosed in British Patent Nos. 952807 and 967074. However, the invention is not specifically limited thereto.

<Water Soluble Resin>

The thermosensitive layer in the invention may contain a water soluble resin as an agent for preventing adhesion between the heat-fusible particles during storage. Examples of the water soluble resin include conventional water soluble polymers, for example, a synthetic homopolymer or copolymer such as polyvinyl alcohol, poly(meth)acrylic acid, poly(meth)acrylamide, polyhydroxyethyl(meth)acrylate or polyvinyl methyl ether, and a natural binder such as gelatin, polysaccharides, for example, dextrane, pullulan, cellulose, gum arabic, alginic acid, polyethylene glycol, or polyethylene oxide. The water soluble polymer content of the thermosensitive layer in the invention is preferably 0 to 50% by weight.

The coating amount of the thermosensitive layer in the invention is preferably in the range of from 0.1 to 1.0 g/m$^2$ of layer. The thermosensitive layer having a coating amount of the layer falling outside the above range is difficult to obtain high printing durability.

<Light-to-Heat Conversion Material>

When in the invention an image is formed employing light to heat conversion due to laser, the thermosensitive layer or hydrophilic layer in the invention preferably contains a light-to-heat conversion material.

As a light-to-heat conversion, a light-to-heat conversion having absorption in the near-infrared wavelength region is preferably used. Examples of the light-to-heat conversion material include an inorganic compound such as carbon black; an organic compound such as a cyanine dye, a polymethine dye, an azulenium dye, a squalenium dye, a thiopyrylium dye, a naphthoquinone dye or an anthraquinone dye; an organic metal complex of phthalocyanine, azo or thioamide type; a metal such as Co, Cr, Fe, Mn, Ni, Cu, or Ti; and an oxide, nitride or nitrogen oxide of the metal.

Exemplarily, the light-to-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds can be used singly or in combination of two or more kinds thereof. In the invention, the content of the near-infrared absorbent in the image forming layer is preferably from 1 to 10% by weight. The content of the near-infrared absorbent in the hydrophilic layer is preferably from 3 to 20% by weight.

In the invention, the content of the light-to-heat conversion material in the hydrophilic layer or the thermosensitive layer is preferably from 3 to 20% by weight.

In the planographic printing plate material of 2) above, comprising two layers having a different ink affinity, the two layers have the following structure (i) or (ii):

(i) a planographic printing plate material comprising a substrate and provided thereon, an ink affinity layer as an image formation layer (a layer having higher affinity to ink), and a hydrophilic layer in that order, or (ii) a planographic printing plate material comprising a substrate and provided thereon, a hydrophilic layer and an ink affinity layer as an image formation layer in that order.

The hydrophilic layer in each structure is the same as that denoted in the hydrophilic layer of the planographic printing plate material of 1) above.

The ink affinity layer may be any as long as it can accept printing ink. Examples of the ink affinity layer include a layer prepared by exposing and hardening the photosensitive polymer as disclosed in Japanese Patent O.P.I. Publication No. 60-22903, a layer prepared by heat hardening epoxy resins as disclosed in Japanese Patent O.P.I. Publication No. 62050760, a layer prepared by hardening a gelatin layer as disclosed in Japanese Patent O.P.I. Publication No. 63-133151, a layer prepared by employing urethane resin and a silane coupling agent as disclosed in Japanese Patent O.P.I. Publication No. 3-200965, and a layer prepared by employing urethane resin as disclosed in Japanese Patent O.P.I. Publication No. 3-273248. Besides the above, a layer prepared by hardening a gelatin or casein layer is also useful. As the substrate, those described above can be used. The coating amount by dry weight of the ink affinity layer on the substrate is suitably from 0.1 to 10 g/m$^2$, preferably from 0.2 to 8 g/m$^2$, and more preferably from 0.5 to 5 g/m$^2$. The substrate itself is also usable as long as it has ink affinity.

In this structure, the hydrophilic layer and/or the ink affinity layer can contain the light-to-heat conversion material described above, in that an image is easily formed by ablation due to irradiation of laser. The light-to-heat conversion material content of the hydrophilic layer is preferably from 5 to 50% by weight, and the light-to-heat conversion material content of the ink affinity layer is preferably from 5 to 50% by weight.

An ablation layer may be provided between the hydrophilic layer and the ink affinity layer.

The ablation layer is a layer containing the light-to-heat conversion material above and a binder. Examples of the binder include cellulose derivatives such as cellulose, nitrocellulose, and ethyl cellulose; a homopolymer or copolymer of acrylates, a homopolymer or copolymer of methacrylates such as methyl methacrylate or butyl methacrylate; acrylate-methacrylate copolymers; a homopolymer or copolymer of styrene such as styrene or α-methylstyrene; synthetic rubbers such as polyisoprene or styrene-butadiene copolymer; polyvinyl esters such as polyvinyl acetate; copolymers of vinylesters such as a vinyl acetate-vinyl chloride copolymer; polycondensation polymer such as polyurea, polyurethane, polyesters and polycarbonates; and binders (used in the so-called "chemical amplification type") disclosed in Frechet et al., J. Imaging Sci., 30(2), 59–64 (1986), "Polymers in Electronics (Symposium Series, P11, 242, T. Davidson, Ed., ACS Washington D.C. (1984) (Ito, Willson))" and E. Reichmanis, and L. F. Thompson, Microelectronic Engineering, 13, pp. 3–10 (1991). The content ratio by weight of light-to-heat conversion material to the binder in the ablation layer is 10:90 to 70:30. The ablation layer can contain various cross-linking agents in order to increase its mechanical strength and its adhesion to another layer adjacent thereto. As the cross-linking agents, formaldehyde, an epoxy resin, a melamine resin, glyoxal, polyisocyanate, and hydrolyzable tetraalkylorthosilicate can be used.

Another embodiment of the ablation layer is a layer formed by vacuum deposition or sputtering of metal-contained particles capable of converting light to heat. The metal-contained particles include particles of a metal such as aluminum, titanium, tellurium, chromium, tin, indium, bismuth, zinc, lead, or their alloy, and particles of metal oxides, metal carbides, metal nitrides, metal borides, or metal fluorides. The vacuum deposition or sputtering method can form a thin layer. The thickness of the ablation layer formed according to the vacuum deposition or sputtering method is preferably from 50 to 1000 Å, and more preferably from 100 to 800 Å.

The planographic printing plate material is exposed to laser or a thermal head to form a recorded image on it. As a light source, laser is preferred in obtaining high resolution.

Lasers usable are properly selected according to an absorption property of light-to-heat conversion material used, but laser emitting light having a wavelength in the near infrared regions is preferred. As laser, a semiconductor laser or a semiconductor excitation solid laser (for example, YAG laser) is preferably used.

EXAMPLES

The present invention will be explained below employing examples, but is not limited thereto.

A hydrophilic layer coating liquid, which was obtained by dispersing the following hydrophilic layer coating composition in a bead mill for 30 minutes, was coated on an adhesive layer of a 175 μm thick polyethylene terephthalate HS74 (produced by Teijin Co., Ltd.) sheet support to give a coating amount of 3 g/m2 and dried at 100° C. for 1 minute.

| <Hydrophilic layer coating composition > | |
|---|---|
| Snowtex S (Colloidal silica, solid 30% by weight, produced by Nissan Kagaku Kogyo Co., Ltd.) | 10.40 parts by weight |
| Snowtex PS-M (Colloidal silica, solid 20% by weight, produced by Nissan Kagaku Kogyo Co., Ltd.) | 23.40 parts by weight |
| AMT Silica 08 (Aluminosilicate particles having an average particle size of 0.6 μm, produced by Mizusawa Kagaku Kogyo Co., Ltd. | 1.50 parts by weight |
| Silton JC 20 (silica particles having an average particle size of 2.0 μm, produced by Mizusawa Kagaku Kogyo Co., Ltd.) | 1.20 parts by weight |
| Aqueous 4% by weight sodium carboxymethyl cellulose solution (produced by Kanto Kagaku Co., Ltd.) | 0.12 parts by weight |
| MF Black 4500 (Aqueous dispersion of Fe—Mn—Cu composite metal oxide, solid content: 40%, produced by Dainichi Seika Kogyo Co., Ltd.) | 2.70 parts by weight |
| Mineral Colloid MO (Montmorillonite produced by WILBUR ELLIS Co., Ltd.) | 0.24 parts by weight |
| Sodium phosphate (produced by Kanto Kagaku Co., Ltd.) | 0.06 parts by weight |
| Pure water | 19.17 parts by weight |

The coated hydrophilic layer was further subjected to aging treatment at 60° C. for 24 hours, and then the following image formation layer coating solution was coated on the resulting hydrophilic layer to give an image formation layer with a dry thickness of 0.6 g/m$^2$, and dried at 40° C. for 3 minutes. Thus, a planographic printing plate material sample was prepared.

| <Image formation layer coating solution> | |
|---|---|
| Hi-Disperser A118 (Carnauba wax aqueous dispersion having a solid content of 40% by weight, produced by Gifu Shellac Co., Ltd.) | 10.5 parts by weight |
| Treha (trehalose produced by Hayashihara Shoji Co., Ltd.) | 1.80 parts by weight |
| Pure water | 8.77 parts by weight |

The resulting planographic printing plate material sample was cut in a size of 745 mm×600 mm, punched, mounted on a drum of a plate setter equipped with a 830 nm semiconductor laser having an output power of 300 mW and a beam diameter of 32 μm (1/e$^2$), and imagewise exposed wherein the drum rotation frequency was adjusted so that exposure energy intensity on the surface of the material was 300 mJ/cm$^2$. The image pattern used for the imagewise exposure comprised a solid image, which was formed on the sample to be in parallel with the drum axis, and a screen tint with a dot area of 95%.

Subsequently, the exposed sample was mounted on a plate cylinder (with a diameter of 135 mm) of a press as shown in FIG. 1, and processed according to the sequences as described below.

Sequence 1 (as shown in Table 3)

The supplied amount of dampening water was slightly increased on the intermediate stage of the pre-dampening step.

TABLE 3

| | | | | | |
|---|---|---|---|---|---|
| 1) | 6) | 1st to 5th | 6th to 7th | 8th to 10th | Not less than 11th |
| | 7) | 0.5 m/sec | 0.5 m/sec | 0.5 m/sec | 1.0 m/sec |
| 2) | 8) | 10 ml/m$^2$ | 25 ml/m$^2$ | 10 ml/m$^2$ | 10 ml/m$^2$ |
| 3) | 9) | No | No | Yes | Yes |
| 4) | 10) | No | No | No | Yes |
| 5) | | Pre-dampening step (developing process on a press) | | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 17 seconds.

Sequence 2 (as shown in Table 4)

The supplied amount of dampening water was slightly increased on the initial stage of the pre-dampening step.

TABLE 4

| | | | | | |
|---|---|---|---|---|---|
| 1) | 6) | 1st to 5th | 6th to 7th | 8th to 10th | Not less than 11th |
| | 7) | 0.5 m/sec | 0.5 m/sec | 0.5 m/sec | 1.0 m/sec |
| 2) | 8) | 20 ml/m$^2$ | 10 ml/m$^2$ | 10 ml/m$^2$ | 10 ml/m$^2$ |
| 3) | 9) | No | No | Yes | Yes |
| 4) | 10) | No | No | No | Yes |
| 5) | | Pre-dampening step (developing process on a press) | | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 17 seconds.

Sequence 3 (as shown in Table 5)

The supplied amount of dampening water was greatly increased on the initial stage of the pre-dampening step.

TABLE 5

| | | | | | |
|---|---|---|---|---|---|
| 1) | 6) | 1st to 5th | 6th to 7th | 8th to 10th | Not less than 11th |
| | 7) | 0.5 m/sec | 0.5 m/sec | 0.5 m/sec | 1.0 m/sec |
| 2) | 8) | 75 ml/m$^2$ | 10 ml/m$^2$ | 10 ml/m$^2$ | 10 ml/m$^2$ |
| 3) | 9) | No | No | Yes | Yes |
| 4) | 10) | No | No | No | Yes |

TABLE 5-continued

| 5) | Pre-dampening step (developing process on a press) | Printing step |
|---|---|---|

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 17 seconds.

Sequence 4 (as shown in Table 6)

The supplied amount of dampening water was greatly increased on the final stage of the pre-dampening step.

TABLE 6

| | | | | | |
|---|---|---|---|---|---|
| 1) | 6) | 1st to 5th | 6th to 7th | 8th to 10th | Not less than 11th |
| | 7) | 0.5 m/sec | 0.5 m/sec | 0.5 m/sec | 1.0 m/sec |
| 2) | 8) | 10 ml/m$^2$ | 10 ml/m$^2$ | 100 ml/m$^2$ | 10 ml/m$^2$ |
| 3) | 9) | No | No | Yes | Yes |
| 4) | 10) | No | No | No | Yes |
| 5) | | Pre-dampening step (developing process on a press) | | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 17 seconds.

Sequence 5 (as shown in Table 7)

The supplied amount of dampening water was not varied during the pre-dampening step.

TABLE 7

| | | | | | |
|---|---|---|---|---|---|
| 1) | 6) | 1st to 5th | 6th to 7th | 8th to 10th | Not less than 11th |
| | 7) | 0.5 m/sec | 0.5 m/sec | 0.5 m/sec | 1.0 m/sec |
| 2) | 8) | 10 ml/m$^2$ | 10 ml/m$^2$ | 10 ml/m$^2$ | 10 ml/m$^2$ |
| 3) | 9) | No | No | Yes | Yes |
| 4) | 10) | No | No | No | Yes |
| 5) | | Pre-dampening step (developing process on a press) | | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 17 seconds.

Sequence 6 (as shown in Table 8)

During the pre-dampening step, the supplied amount of dampening water was not varied but the circumferential speed of the cylinder was varied.

TABLE 8

| | | | | |
|---|---|---|---|---|
| 1) | 6) | 1st to 7th | 8th to 10th | Not less than 11th |
| | 7) | 1.0 m/sec | 0.5 m/sec | 1.0 m/sec |
| 2) | 8) | 10 ml/m$^2$ | 10 ml/m$^2$ | 10 ml/m$^2$ |
| 3) | 9) | No | Yes | Yes |
| 4) | 10) | No | No | Yes |
| 5) | | Pre-dampening step (developing process on a press) | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 10 seconds.

Sequence 7 (as shown in Table 9)

During the pre-dampening step, the supplied amount of dampening water was not varied but the circumferential speed of the cylinder was varied.

TABLE 9

| | | | | |
|---|---|---|---|---|
| 1) | 6) | 1st to 7th | 8th to 10th | Not less than 11th |
| | 7) | 2.5 m/sec | 0.5 m/sec | 1.0 m/sec |
| 2) | 8) | 10 ml/m$^2$ | 10 ml/m$^2$ | 10 ml/m$^2$ |
| 3) | 9) | No | Yes | Yes |
| 4) | 10) | No | No | Yes |
| 5) | | Pre-dampening step (developing process on a press) | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 6 seconds.

Sequence 8 (as shown in Table 10)

The supplied amount of dampening water was greatly increased at the initial stage of the pre-dampening step, and the circumferential speed of the cylinder was varied during the pre-dampening step.

TABLE 10

| | | | | |
|---|---|---|---|---|
| 1) | 6) | 1st to 3rd | 4th to 5th | Not less than 6th |
| | 7) | 2.5 m/sec | 0.5 m/sec | 1.0 m/sec |
| 2) | 8) | 100 ml/m$^2$ | 10 ml/m$^2$ | 10 ml/m$^2$ |
| 3) | 9) | No | Yes | Yes |
| 4) | 10) | No | No | Yes |

TABLE 10-continued

| 5) | Pre-dampening step (developing process on a press) | Printing step |
|---|---|---|

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 3 seconds.

Sequence 9 (as shown in Table 11)

The circumferential speed of the plate cylinder was varied at the step (a) of the pre-dampening step.

TABLE 11

| | | | | | |
|---|---|---|---|---|---|
| 1) | 6) | 1st to 3rd | 4th to 7th | 8th to 10th | Not less than 11th |
| | 7) | 0.5 m/sec | 1.5 m/sec | 0.5 m/sec | 1.0 m/sec |
| 2) | 8) | 10 ml/m$^2$ | 10 ml/m$^2$ | 10 ml/m$^2$ | 10 ml/m$^2$ |
| 3) | 9) | No | No | Yes | Yes |
| 4) | 10) | No | No | No | Yes |
| 5) | | Pre-dampening step (developing process on a press) | | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 14 seconds.

Sequence 10 (as shown in Table 12)

The circumferential speed of the plate cylinder was varied at the step (b) of the pre-dampening step.

TABLE 12

| | | | | | |
|---|---|---|---|---|---|
| 1) | 6) | 1st to 3rd | 4th to 7th | 8th to 10th | Not less than 11th |
| | 7) | 0.5 m/sec | 2.5 m/sec | 0.5 m/sec | 1.0 m/sec |
| 2) | 8) | 10 ml/m$^2$ | 10 ml/m$^2$ | 10 ml/m$^2$ | 10 ml/m$^2$ |
| 3) | 9) | No | Yes | Yes | Yes |
| 4) | 10) | No | No | No | Yes |
| 5) | | Pre-dampening step (developing process on a press) | | | Printing step |

1) Cylinder
2) Dampening water supply
3) Inking roller
4) Printing paper
5) Kinds of step
6) Number of rotations
7) Circumferential speed
8) Supplied amount of dampening water to the planographic printing plate material
9) Contact of inking roller with the planographic printing plate material
10) Printing paper feeding Time taken to carry out the above pre-dampening step was about 11 seconds.

Prints obtained in each of the sequences were evaluated according to the following criteria.

<<Elimination of Filling-Up in the Image of a Screen Tint with a Dot Area of 95%>>

The number of paper sheets printed from when printing began till when the image of a screen tint with a dot area of 95% was reproduced (filling-up in the image of a screen tint with a dot area of 95% was completely eliminated) was counted.

<<Stability of Image Density of Image Density of Solid Image>>

The number of paper sheets printed from when printing began till when an intended image density was obtained at the solid image was counted.

The results are shown in Table 13.

TABLE 13

| Sequence No. | Time taken in pre-dampening step (seconds) | Elimination of filling-up in the image of screen tint (number of prints) | Stability of image density of solid image (number of prints) | Remarks |
|---|---|---|---|---|
| 1 | About 17 | 12 | 6 | Inv. |
| 2 | About 17 | 8 | 3 | Inv. |
| 3 | About 17 | 1 | 1 | Inv. |
| 4 | About 17 | 6 | 8 | Inv. |
| 5 | About 17 | 30 | 20 | Comp. |
| 6 | About 10 | 5 | 1 | Inv. |
| 7 | About 6 | 2 | 1 | Inv. |
| 8 | About 3 | 1 | 1 | Inv. |
| 9 | About 14 | 3 | 2 | Inv. |
| 10 | About 11 | 2 | 2 | Inv. |

Inv.: Inventive,
Comp.: Comparative

As is apparent from Table 13, the developing process, in which in the pre-dampening step, the supplied amount of the dampening water is varied or the circumferential speed of the plate cylinder is varied, provides greatly reduced paper waste in the initial printing stage, even if time taken in the pre-dampening step is short.

EFFECT OF THE INVENTION

The present invention provides a developing process on a press of a planographic printing plate material in which development is smoothly carried out, and which can shorten the set-up time for printing, and greatly reduces printing paper waste at an initial printing step.

What is claimed is:

1. A developing process on a press of a planographic printing plate material comprising a hydrophilic layer and an image formation layer, which is capable of being developed with water or capable of being developed on a press, the process comprising the steps of:

(a) supplying dampening water to the planographic printing plate material with a recorded image mounted on a plate cylinder of a press by bringing a dampening roller into contact with the planographic printing plate material while rotating the plate cylinder; and (b) then supplying ink to the planographic printing plate material by bringing an ink roller into contact with the planographic printing plate material to remove an image formation layer unnecessary for printing, wherein in the step (a), the supplied amount of the dampening water is varied.

2. The developing process of claim 1, wherein the supplied amount of the dampening water at an initial stage of the step (a) is varied to be greater than that at a final stage of the step (a).

3. The developing process of claim 2, wherein the supplied amount of the dampening water at the initial stage of the step (a) is from 30 to 200 ml/m$^2$ of the planographic printing plate material, and the supplied amount of the dampening water at the final stage of the step (a) is from 5 ml/m$^2$ to less than 30 ml/m$^2$ of the planographic printing plate material.

4. A printing process comprising the steps of:

developing a planographic printing plate material comprising a hydrophilic layer and an image formation layer, which is capable of being developed with water or capable of being developed on a press, according to the developing process of claim 1 to prepare a planographic printing plate;

supplying ink and dampening water to the resulting planographic printing plate to form an ink image on the planographic printing plate; and transferring the ink image to a paper sheet.

5. A developing process on a press of a planographic printing plate material comprising a hydrophilic layer and an image formation layer, which is capable of being developed with water or capable of being developed on a press, the process comprising the steps of:

(a) supplying dampening water to a planographic printing plate material with a recorded image mounted on a plate cylinder of a press by bringing a dampening roller into contact with the planographic printing plate material while rotating the plate cylinder; and (b) then supplying ink to the planographic printing plate material by bringing an ink roller into contact with the planographic printing plate material to remove an image formation layer unnecessary for printing, wherein in the step (a), a circumferential speed of the plate cylinder (a distance which a point in the circumference of the plate cylinder advances in a unit time) is varied.

6. The developing process of claim 5, wherein in the step (a), the circumferential speed of the plate cylinder is varied in the range of from 0.5 to 3.0 m/second.

7. The developing process of claim 6, wherein at a certain period in the step (a), the circumferential speed of the plate cylinder is 2.0 to 3.0 m/second.

8. A printing process comprising the steps of:

developing a planographic printing plate material comprising a hydrophilic layer and an image formation layer, which is capable of being developed with water or capable of being developed on a press, according to the developing process of claim 5 to prepare a planographic printing plate;

supplying ink and dampening water to the resulting planographic printing plate to form an ink image on the planographic printing plate; and transferring the ink image to a paper sheet.

9. A developing process on a press of a planographic printing plate material comprising a hydrophilic layer and an image formation layer, which is capable of being developed with water or capable of being developed on a press, the process comprising the steps of:

(a) supplying dampening water to a planographic printing plate material with a recorded image mounted on a plate cylinder of a press by bringing a dampening roller into contact with the planographic printing plate material while rotating the plate cylinder; and (b) then supplying ink to the planographic printing plate material by bringing an ink roller into contact with the planographic printing plate material to remove an image formation layer unnecessary for printing, wherein in the step (b), a circumferential speed of the plate cylinder is varied.

10. The developing process of claim 9, wherein in the step (b), the circumferential speed of the plate cylinder is varied in the range of from 0.5 to 3.0 m/second.

11. A printing process comprising the steps of:

developing a planographic printing plate material comprising a hydrophilic layer and an image formation layer, which is capable of being developed with water or capable of being developed on a press, according to the developing process of claim 9 to prepare a planographic printing plate;

supplying ink and dampening water to the resulting planographic printing plate to form an ink image on the planographic printing plate; and transferring the ink image to a paper sheet.

12. A developing process on a press of a planographic printing plate material comprising a hydrophilic layer and an image formation layer, which is capable of being developed with water or capable of being developed on a press, the process comprising the steps of:

(a) supplying dampening water to a planographic printing plate material with a recorded image mounted on a plate cylinder of a press by bringing a dampening roller into contact with the planographic printing plate material while rotating the plate cylinder; and (b) then supplying ink to the planographic printing plate material by bringing an ink roller into contact with the planographic printing plate material to remove an image formation layer unnecessary for printing, wherein a circumferential speed of the plate cylinder in the step (a) is different from that in the step (b).

13. A printing process comprising the steps of:

developing a planographic printing plate material comprising a hydrophilic layer and an image formation layer, which is capable of being developed with water or capable of being developed on a press, according to the developing process of claim 12 to prepare a planographic printing plate;

supplying ink and dampening water to the resulting planographic printing plate to form an ink image on the planographic printing plate; and transferring the ink image to a paper sheet.

* * * * *